US010113380B2

(12) United States Patent
Mangum et al.

(10) Patent No.: US 10,113,380 B2
(45) Date of Patent: Oct. 30, 2018

(54) PUMPING SYSTEM DEPLOYMENT USING CABLE

(71) Applicant: SCHLUMBERGER TECHNOLOGY CORPORATION, Sugar Land, TX (US)

(72) Inventors: Jared M. Mangum, Richmond, TX (US); Antonio Mauricio Cevallos Navarrete, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/504,818

(22) PCT Filed: Aug. 19, 2014

(86) PCT No.: PCT/US2014/051677
§ 371 (c)(1),
(2) Date: Feb. 17, 2017

(87) PCT Pub. No.: WO2016/028271
PCT Pub. Date: Feb. 25, 2016

(65) Prior Publication Data

US 2017/0241222 A1 Aug. 24, 2017

(51) Int. Cl.
*E21B 23/14* (2006.01)
*E21B 33/072* (2006.01)
*E21B 43/12* (2006.01)

(52) U.S. Cl.
CPC ..... *E21B 23/14* (2013.01); *E21B 33/072* (2013.01); *E21B 43/128* (2013.01)

(58) Field of Classification Search
CPC ..... E21B 23/14; E21B 33/072; E21B 43/128
See application file for complete search history.

(56) References Cited

U.S. PATENT DOCUMENTS 5,145,007 A 9/1992 Dinkins
5,890,534 A * 4/1999 Burge ..... B65H 51/14 166/77.3
6,234,253 B1 * 5/2001 Dallas ..... E21B 19/00 166/377
6,712,147 B2 * 3/2004 Dallas ..... E21B 33/03 166/379

(Continued)

FOREIGN PATENT DOCUMENTS

WO 2010065993 A1 6/2010

OTHER PUBLICATIONS

International Preliminary Report on Patentability for corresponding PCT Application Serial No. PCT/US2014/051677, dated Feb. 21, 2017, 10 pages.

*Primary Examiner* — Matthew R Buck

(57) ABSTRACT

A technique facilitates rigless deployment of a pumping system, e.g. an electric submersible pumping system, to a desired downhole location. The pumping system is coupled to an electrical cable which is routed through an injector head. The pumping system is supported on the electrical cable and conveyed downhole to the desired position in a wellbore via the injection head. The system and methodology enable deployment of the electrical cable directly through the injector head without coiled tubing.

16 Claims, 3 Drawing Sheets

(56) References Cited

U.S. PATENT DOCUMENTS

| | | | | |
|---|---|---|---|---|
| 6,817,423 | B2 * | 11/2004 | Dallas | E21B 17/1007 166/382 |
| 6,827,147 | B2 * | 12/2004 | Dallas | E21B 33/072 166/360 |
| 7,168,495 | B2 * | 1/2007 | Dallas | E21B 33/068 166/379 |
| 7,210,525 | B2 * | 5/2007 | Dallas | E21B 33/068 166/77.4 |
| 2009/0272520 | A1 * | 11/2009 | Hug | E21B 19/22 166/77.2 |
| 2012/0205125 | A1 | 8/2012 | Zupanick | |
| 2013/0277042 | A1 | 10/2013 | Scarsdale et al. | |
| 2013/0315751 | A1 * | 11/2013 | Fielder | E21B 19/002 417/44.1 |
| 2016/0186507 | A1 * | 6/2016 | Varkey | E21B 43/128 166/250.01 |

* cited by examiner

PUMPING SYSTEM DEPLOYMENT USING CABLE

BACKGROUND

Hydrocarbon fluids such as oil and natural gas are obtained from a subterranean geologic formation, referred to as a reservoir, by drilling a wellbore that penetrates the hydrocarbon-bearing formation. An electric submersible pumping system may be deployed downhole in the wellbore and operated to pump or lift well fluids to a collection location. The electric submersible pumping system often is deployed downhole via coiled tubing which, in turn, is conveyed downhole by a rig and a coiled tubing injector. When a downhole electric submersible pumping system fails, waiting for the rig to be delivered, as well as the rig set up and rig take down, can be very costly and time-consuming.

SUMMARY

In general, a methodology and system are provided to enable a rapid, simple, and cost effective method for deploying a pumping system, e.g. an electric submersible pumping system, to a desired downhole location. The pumping system is coupled to an electrical cable which has been routed through an injector head. The pumping system is supported on the electrical cable and conveyed downhole to the desired position in a wellbore via the injection head. The system and methodology enable deployment of the electrical cable directly through the injector head without coiled tubing and without a rig.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a methodology and system which facilitate deployment of pumping systems, e.g. electric submersible pumping systems, downhole into a well. A pumping system may be deployed on electrical cable via an injector head, e.g. a coiled tubing injector head, to a desired location along a wellbore. The methodology enables use of the coiled tubing injector head in a manner such that the electrical cable replaces the coiled tubing and is directly injected via the coiled tubing injector head. The pumping system is deployed into the well on an end of the electrical cable.

The methodology further enables deployment of the pumping system without a rig. By supporting the pumping system on electrical cable and by using the injector head to directly inject the electrical cable, the pumping system deployment may be accomplished without incurring the time and expense associated with use of the rig. Thus, when a downhole pumping system fails, the time spent waiting for the rig, as well as the rig set up and rig teardown time, can be avoided. Accordingly, the rigless nature of using the coiled tubing injector head or another suitable injector head increases operational efficiency. By deploying the electrical cable directly through the injector head and without coiled tubing, substantial weight and space savings also are realized, and those savings are of considerable value in offshore deployments and in a variety of other operations.

In an embodiment, the system and methodology may be used to provide a rapid, simple, and cost effective method for deploying an electric submersible pumping system to a desired downhole location. The electric submersible pumping system is coupled to an electrical cable and the cable is routed through an injector head. The electric submersible pumping system is supported on the electrical cable and conveyed downhole to the desired position in a wellbore via the injection head. In this specific example, the system and methodology again enable deployment of the electrical cable directly through a coiled tubing type injector head without coiled tubing and without a rig.

Figure 1:
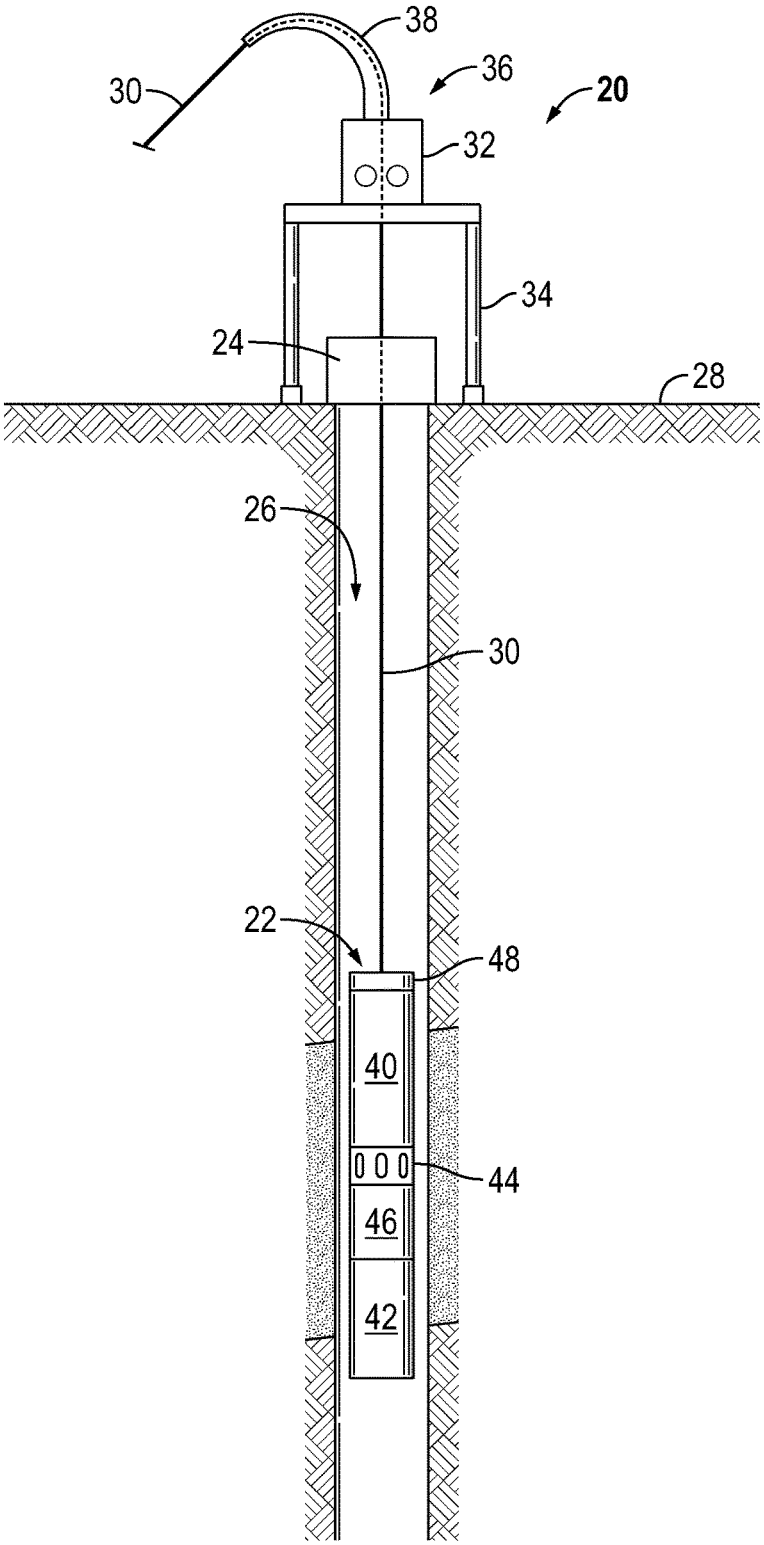
FIG. 1 is a schematic illustration of an example of a pumping system, e.g. an electric submersible pumping system, deployed downhole into a wellbore, according to an embodiment of the disclosure.

Referring generally to FIG. 1, an example of a system 20 for deploying a pumping system 22 is illustrated. In this example, the pumping system 22 is deployed beneath a wellhead 24 and moved downhole to a desired location in a wellbore 26. The wellhead 24 is positioned at a surface location 28 which may be a land surface or a subsea surface. The pumping system 22 is deployed downhole on an electrical cable 30 and the electrical cable 30 is conveyed downhole via an injection head 32, such as a coiled tubing injection head, positioned over the wellhead 24.

By way of example, the injection head 32 may be located over wellhead 24 by an adjustable system 34, e.g. a jack stand, a crane, or another suitable system, which is adjustable in height. In a specific example, the injection head 32 comprises a coiled tubing injection head which is part of an overall coiled tubing injection head system 36 having a guide arch or goose neck 38. The guide arch 38 is coupled with the injection head 32 so as to help guide electrical cable 30 into and through the injection head 32 when the electrical cable 30 is used to convey pumping system 22 downhole into wellbore 26. In some applications, the injection head 32 may be mounted above and separate from the stand 34.

In a variety of applications, the pumping system 22 is in the form of an electric submersible pumping system which may have many types of electric submersible pumping system components. Examples of electric submersible pumping system components include a submersible pump 40 powered by a submersible motor 42. The electric submersible pumping system components also may comprise a pump intake 44, a motor protector 46, and a system coupling 48 by which the electric submersible pumping system 22 is coupled with electrical cable 30. In many applications, the submersible motor 42 may be in the form of a submersible, centrifugal motor and may be operated to pump injection fluids and/or production fluids. In some applications, the pumping system 22 may comprise an inverted electric submersible pumping system in which the pumping system components are arranged with the submersible pump 40 below the submersible motor 42. However, pumping system 22 may comprise a variety of pumping systems and pumping system components.

In an operational example, the pumping system 22, e.g. the electric submersible pumping system, is coupled to electrical cable 30. The electrical cable 30 is routed through the coiled tubing injector head 32 and wellhead 24. The electrical cable 30 is thus able to convey the pumping system 22 to a desired position in wellbore 26 without the aid of coiled tubing or a rig.

Figure 2:
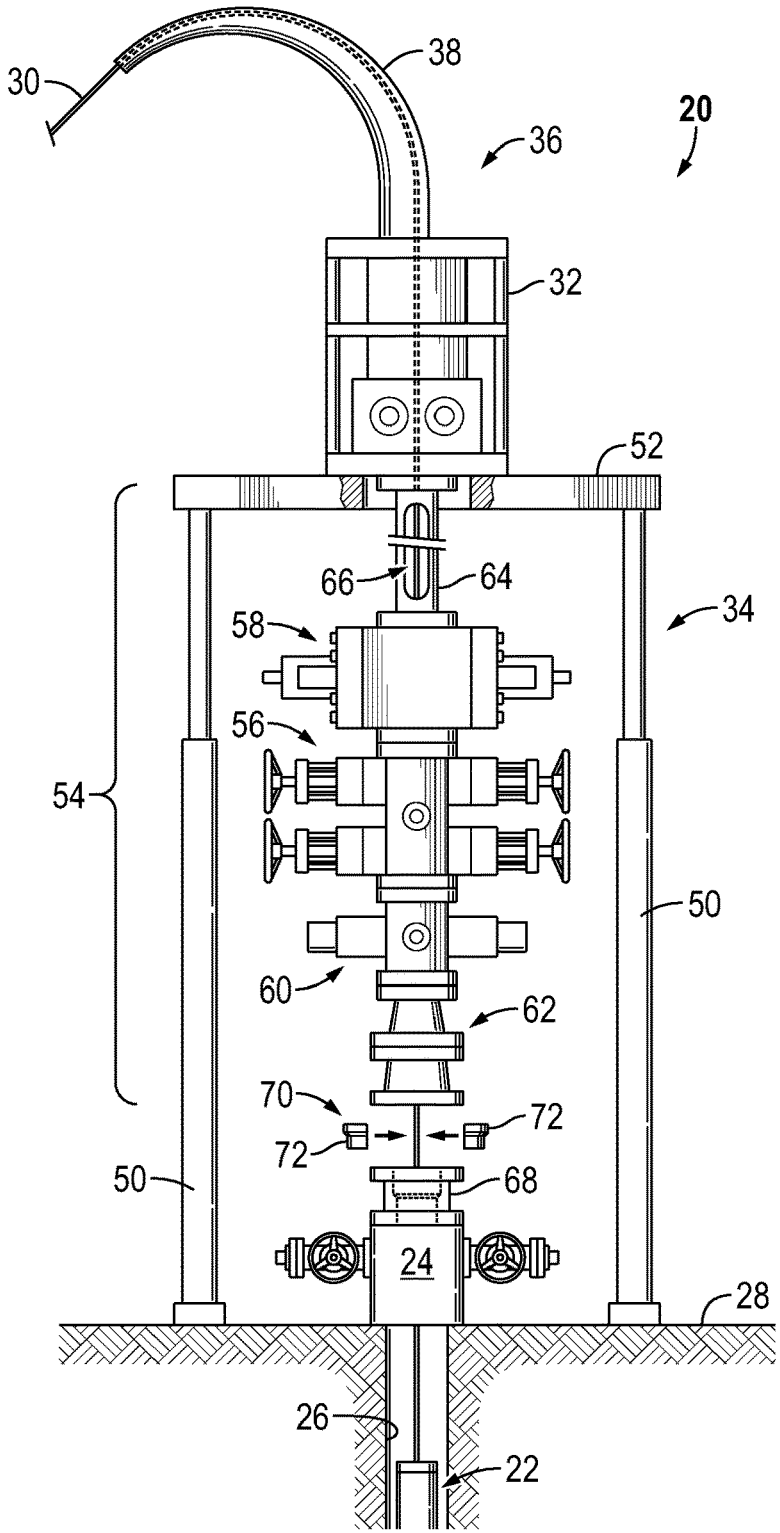
FIG. 2 is a front elevation view of an example of a system for deploying the pumping system downhole into the wellbore via electrical cable without the use of a rig or coiled tubing, according to an embodiment of the disclosure.

Referring generally to FIG. 2, another embodiment of system 20 is illustrated. In this embodiment, injector head 32 is mounted to adjustable system 34 over wellhead 24. If adjustable system 34 comprises a jack stand, the jack stand 34 may be adjustable in height via actuators 50 coupled with a structure 52 of the jack stand 34. For example, stand 34 may be hydraulically adjustable via hydraulic actuators 50 which may be operated to raise and lower the height of structure 52. In this example, the injector head is a coiled tubing injector head 32 mounted on structure 52. Additionally, a tree assembly 54, e.g. a Christmas tree assembly, is coupled to structure 52 so as to enable movement of both injector head 32 and tree assembly 54 to different heights above wellhead 24. It should be noted, however, adjustable system 34 also may be in the form of a crane for use in a crane suspended operation. In this latter embodiment, the adjustable crane 34 is attached to the injector head 32 so as to enable raising and lowering of the injector head 32 and/or tree assembly 54.

The tree assembly 54 may comprise a variety of components depending on the parameters of a given application. By way of example, the tree assembly 54 may comprise a blowout preventer (BOP) 56 and a stripper 58 located above the BOP 56. In the example illustrated, the tree assembly 54 also comprises a cable clamp 60, which may be located below the BOP 56, and crossover flanges 62 which may be located below the cable clamp 60. Additionally, the tree assembly 54 may comprise a standoff 64 which may include a work window 66. The standoff 64 may be located above stripper 58 and may be used to couple the tree assembly 54 with the movable structure 52 of adjustable stand 34. Depending on the application, the arrangement of components in tree assembly 54 may be changed and/or components may be added or removed.

In this embodiment, system 20 also comprises a hanging spool 68 which may be positioned above, e.g. on, wellhead 24. Additionally, a device 70, e.g. a split hanger, may be used between hanging spool 68 and tree assembly 54. In the example illustrated, device 70 is in the form of a split hanger 70 having a plurality of hanger components 72, e.g. two hanger components 72, which can be selectively assembled and disassembled to facilitate deployment of the pumping system 22 via electrical cable 30.

To facilitate deployment of electric submersible pumping system 22 (or another suitable pumping system), the hanging spool 68 is constructed with a suitable hanger profile and placed on wellhead 24, as illustrated. The tree assembly 54 is installed onto, e.g. coupled with, the adjustable stand 34 above the hanging spool 68 and wellhead 24. After the electrical cable 30 is made up to the pumping system 22, e.g. connected with the system coupling 48, the split hanger 70 may be installed. Once the split hanger 70 is installed, the tree assembly 54 may be lowered toward the split hanger 70 and onto the hanging spool 68. At this stage, the pumping system 22 may be run downhole into wellbore 26 by injecting the electrical cable 30 via the injector head 32. It should be noted the split hanger is only one type of device 70, and many devices and methods may be employed for installing the pumping system 22. For example, the cable 30 may be cut and an upper termination may be completed so that a hanger may be attached to the upper termination via work window 66. In this example, the entire termination and hanger assembly may then be lowered into the spool hanger 68 from the work window 66.

In the example illustrated, hanging the pumping system 22 in wellbore 26 (once pumping system 22 has been run to the desire downhole position) may be accomplished by utilizing cable clamp 60 which is capable of holding the entire weight of the pumping system 22 and electrical cable 30. After clamping electrical cable 30 via cable clamp 60, the electrical cable 30 can be cut to the appropriate seating length. A suitable upper hanging and pack off assembly may then be assembled to the free upper end of the electrical cable 30 through the standoff 64 and work window 66. The upper hanging and pack off assembly is then reconnected to the portion of electrical cable 30 (or to another suitable deployment cable) which extends from the injector head 32. After the electrical cable 30 has been reconnected, the cable clamp 60 may be released.

In this manner, the upper hanging and pack off assembly may be lowered into the split hanger 70. Once landed in the split hanger 70, the tree assembly 54 may be disconnected from the setting/hanging spool 68 and raised via the adjustable stand 34. The electrical cable 30 (or other suitable deployment cable) can then be disconnected from the injector head 32 to enable removal of the entire tree assembly 54 and the injector head 32. At this stage, the wellhead 24 can be made ready for production of well fluid via pumping system 22.

The procedure for deploying pumping system 22 downhole to a desired location in wellbore 26 may vary according to the parameters of a given application, including environmental parameters and the type of equipment employed. An embodiment of a procedure for deploying pumping system 22 can be performed in stages, as illustrated in the flowcharts of FIGS. 3-5.

Figure 3:
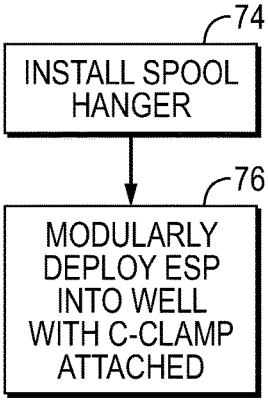
FIG. 3 is a flowchart illustrating an example of a portion of a methodology for rigless deployment of the pumping system, according to an embodiment of the disclosure.

Referring initially to FIG. 3, the procedure comprises initially installing spool hanger 68, as represented by block 74. In this example, the pumping system 22 comprises an electric submersible pumping system which is deployed modularly through wellhead 24 and into wellbore 26, as represented by block 76. By way of example, the modular deployment of electric submersible pumping system 22 may be facilitated by attaching a C-clamp to the components of the electric submersible pumping system 22 for support during assembly.

Figure 4:
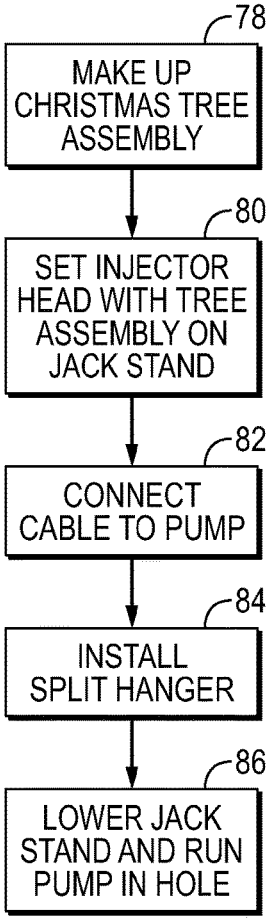
FIG. 4 is a flowchart illustrating an example of a another portion of a methodology for rigless deployment of the pumping system, according to an embodiment of the disclosure.
Figure 5:
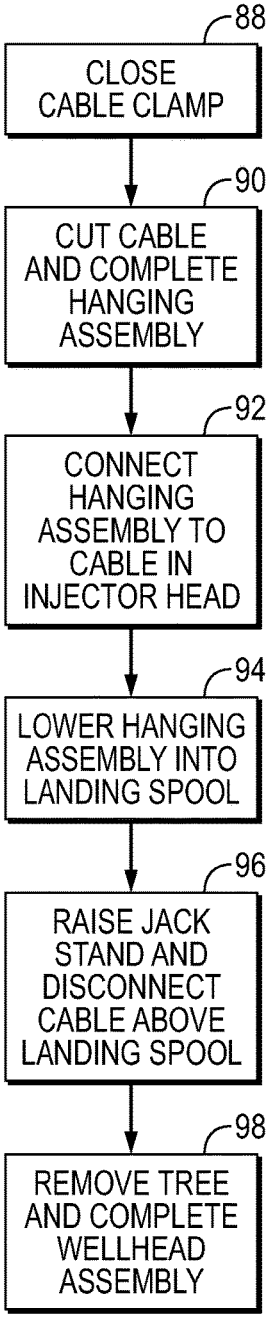
FIG. 5 is a flowchart illustrating an example of another portion of a methodology for rigless deployment of the pumping system, according to an embodiment of the disclosure.

In this example, another stage of the procedure comprises making up the tree assembly 54, as represented by block 78 in FIG. 4. The coiled tubing injector head 32 and the tree assembly 54 are then coupled with adjustable system 34, e.g.

coupled with a crane or with structure 52 of an adjustable jack stand, as represented by block 80. Once the coiled tubing injector head 32 is installed, the electrical cable 30 may be routed through the injector head 32 and connected to the electric submersible pumping system 22 via coupling 48, as represented by block 82. The split hanger 70 is then installed, as represented by block 84, and the height of adjustable system 34 is reduced. For example, structure 52 may be lowered via actuators 50, e.g. hydraulic actuators, to move tree assembly 54 downwardly into engagement with spool hanger 68, as represented by block 86.

This arrangement allows the electric submersible pumping system 22 to be run downhole into wellbore 26 via electrical cable 30 without the use of coiled tubing or a surface rig. As described above, the weight of the electric submersible pumping system 22 is supported by electrical cable 30, and deployment of the electrical cable 30 is controlled by the coiled tubing injector head 32. The coiled tubing injector head 32 is operated to move the electric submersible pumping system 22 to, for example, a desired pumping or injection location within wellbore 26.

After deployment of the electric submersible pumping system 22 to the desired downhole location in wellbore 26, cable clamp 60 is closed on electrical cable 30, as represented by block 88 in FIG. 5. The cable clamp 60 supports the weight of the electric submersible pumping system 22 and the associated electrical cable 30 suspended below the cable clamp 60. Once clamped by cable clamp 60, the electrical cable 30 can be cut to a desired length above the cable clamp 60 for installation of a suitable hanging and pack off assembly, as represented by block 90. The hanging and pack off assembly may be connected to the electrical cable 30 at, for example, the coiled tubing injector head 32, as represented by block 92. For example, the hanging and pack off assembly may be connected to the free upper end of electrical cable 30 through work window 66 at standoff 64. It should be noted the hanging and pack off assembly may comprise a variety of available or specifically constructed assemblies which support the pumping system 22 at the wellhead while forming a desired seal with respect to the wellbore 26.

The electrical cable 30 is then reconnected via a suitable connection assembly. For example, the upper end of cable 30 at the hanging and pack off assembly may be connected to the lower end of electrical cable 30 extending from coiled tubing injector head 32. The cable clamp 60 is then released and the hanging and pack off assembly is lowered and landed into the split hanger 70 via injector head 32, as represented by block 94. Once the hanging assembly has been landed at split hanger 70, the tree assembly 54 may be lifted away from hanging spool 68 by raising adjustable system 34, e.g. raising the crane or raising the structure 52, as represented by block 96.

Subsequently, the electrical cable 30 may be disconnected above the hanging spool 68 and the split hanger 70. For example, the cable connection assembly may be uncoupled to disconnect the upper portion of the electrical cable 30 from the lower portion of the electrical cable 30 supporting electric submersible pumping system 22. This allows the tree assembly 54 to be removed so as to enable completion of the wellhead for production operations (or other operations), as represented by block 98. The methodology described herein enables the electric submersible pumping system 22 to be placed downhole quickly and efficiently via operation of the coiled tubing injector head 32 without utilizing coiled tubing or a surface rig.

Depending on the application, the pumping system 20 may be constructed as an electric submersible pumping system or a variety of other pumping systems. Additionally, the pumping system 20 may comprise many types of pumping system components having various configurations. The pumping system 20 also may be powered via electricity received through a variety of electrical cables 30 having various arrangements of conductors, insulation layers, strengthening members, armor, and/or other components depending on the parameters of the specific application.

Similarly, the wellhead 24, injection head 32, tree assembly 54, spool hanger 68, and/or split hanger 70 may have various components and configurations. For example, the split hanger may be replaced by various other types of hangers or other types of tools. The electrical cable 30 may be cut, clamped, reconnected, and disconnected via various devices, assemblies and procedures. Additionally, the operational procedure of deploying the pumping system 22 downhole to a desired location in wellbore 26 may vary depending on the equipment employed and the parameters of a given deployment operation. The sequence of assembly and disassembly of the various components may be adjusted according to such equipment and/or parameters. In electric submersible pumping system applications, the pumping system 22 may be constructed for and used in many types of production applications, injection applications, and/or other pumping applications.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for deploying a pumping system, comprising:

moving a coiled tubing injector head into position over a wellhead positioned above a wellbore of a well;

routing an electrical cable through the coiled tubing injector head and through a tree assembly positioned above the wellhead;

coupling the electrical cable to an electric submersible pumping system beneath the coiled tubing injector head; and using the coiled tubing injector head to deploy the electrical cable and to thus lower the electric submersible pumping system downhole into the wellbore beneath the wellhead without coiled tubing; and wherein moving comprises coupling the coiled tubing injector head to an adjustable system located adjacent the wellhead, wherein the adjustable system is configured to selectively lift or lower the coiled tubing injector head and the tree assembly relative to the wellhead.

2. The method as recited in claim 1, wherein routing further comprises routing the electrical cable through a blowout preventer.

3. The method as recited in claim 1, wherein routing further comprises routing the electrical cable through a stripper.

4. The method as recited in claim 1, wherein routing further comprises routing the electrical cable through a cable clamp.

5. The method as recited in claim 1, wherein routing further comprises routing the electrical cable through a split hanger.

6. The method as recited in claim 5, wherein routing further comprises routing the electrical cable through a hanging spool.

7. The method as recited in claim 1, wherein routing further comprises routing the electrical cable through a blowout preventer, a cable clamp, a split hanger, and a hanging spool.

8. The method as recited in claim 1, further comprising hanging the electric submersible pumping system from a hanger.

9. The method as recited in claim 8, further comprising splitting the electrical cable above the hanger, and removing the coiled tubing injector head.

10. A system for deployment into a well, comprising:

an adjustable system located adjacent a wellhead positioned above a wellbore of the well;

a tree assembly located above the wellhead and coupled to the adjustable system;

an injector head positioned above the tree assembly and coupled to the adjustable system;

an electrical cable extending through the injector head and the tree assembly;

an electric submersible pumping system suspended by the electrical cable and supported by the electrical cable as the electric submersible pumping system is deployed into the wellbore beneath the tree assembly and the wellhead via the injector head; and wherein the tree assembly and the injector head are selectively lifted and lowered relative to the wellhead by the adjustable system.

11. The system as recited in claim 10, wherein the adjustable system is adjustable hydraulically.

12. The system as recited in claim 10, further comprising a split hanger positioned beneath the tree assembly.

13. The system as recited in claim 12, wherein the tree assembly comprises a cable clamp.

14. A method, comprising:

routing an electrical cable through an injector head coupled to a stand having an adjustable height located adjacent a wellbore;

routing the electrical cable through a tree assembly positioned above the wellbore and coupled to the stand;

coupling an electric submersible pumping system to the electrical cable;

conveying the electric submersible pumping system to a desired position in the wellbore via the electrical cable by deploying the electrical cable directly through the injector head and the tree assembly as the electrical cable supports the electric submersible pumping system; and using the stand to selectively lift and lower the injector head and the tree assembly relative to the wellbore.

15. The method as recited in claim 14, further comprising lowering the tree assembly to a hanger spool prior to conveying the electric submersible pumping system to the desired position.

16. The method as recited in claim 15, further comprising hanging the electric submersible pumping system in the wellbore and removing the injector head and the tree assembly.

* * * * *